US005775538A

United States Patent [19]

Covington et al.

[11] Patent Number: 5,775,538

[45] Date of Patent: Jul. 7, 1998

[54] GOLF TEE SHAKER

[76] Inventors: Ronnie Covington; Jim Covington, both of 400 Georgetown, Richardson, Tex. 75081

[21] Appl. No.: 532,856

[22] Filed: Sep. 22, 1995

[51] Int. Cl.[6] ..... A47F 1/04

[52] U.S. Cl. ..... 221/307; 224/918

[58] Field of Search ..... 221/281, 185, 221/307, 308, 303, 167, 173, 156; 224/918; 273/317.2

[56] References Cited

U.S. PATENT DOCUMENTS 3,902,634 9/1975 Bromley et al. ..... 221/310

4,573,610 3/1986 Hurner ..... 221/281

4,875,579 10/1989 Tak ..... 206/315.1

5,056,697 10/1991 Sheffield ..... 224/253

5,476,289 12/1995 Hoyt et al. ..... 224/918

*Primary Examiner*—Kenneth Noland

[57] ABSTRACT

A cylindrical golf tee carrier and dispenser which permits carrying a quantity of tees without accidental loss, while providing for easy removal of tees, one at a time, through an elastomeric dispensing end, and an attaching member mounted thereto for attaching the golf accessory to a golf bag.

2 Claims, 1 Drawing Sheet

GOLF TEE SHAKER

BACKGROUND OF THE INVENTION (1) Field of the Invention

The present invention relates to the art of dispensing, and more particularly to a container and dispenser for golf tees.

(2) Description of Related Art

A golf tee is a wooden or plastic peg used by a golfer to elevate a golf ball above the ground before striking the golf ball. Generally, a golf tee comprises an elongated body that is symmetrical about a longitudinal axis. A tee has a point on one end and an enlarged circular head with a recess at the other end. The point and head are separated by a cylindrical shaft. The pointed end of the golf tee is pushed into the ground, and a golf ball is placed on top of the golf tee head. Golf tees are about two inches long. The shaft has a diameter of about three-sixteenths of an inch, and the head has a diameter of about one-half of an inch.

A golfer must carry a supply of tees because tees are often damaged when the golf ball is hit. Traditionally, golfers have carried tees within garment pockets or within a golf bag. Most methods of carrying tees are condusive to accidental loss whenever the carrier permits ease of dispensing. Carrying tees in a pocket can be unsafe or damaging to the garment due to the pointed ends of the tees. Carrying tees in the golf bag is often inconvenient and results in delay of the game, a condition discouraged by golf etiquette.

A variety of devices have been developed to overcome these shortcomings. In U.S. Pat. No. 5,056,697, Sheffield describes a golf tee holder which stores the tees in a longitudinal channel having one closed end and a raised frictional surface at the other end which prevents accidental removal of the tees from the holder. In U.S. Pat. No. 4,875,579, Tak describes a golf accessory carrier that includes a tee dispenser. The tees are stacked on top of each other and are held in place by "fingers" on the collar cap. In U.S. Pat. No. 4,573,610, Hurner describes a golf tee dispenser for housing a plurality of golf tees. The tees are stacked one atop the other, and are dispensed through an elastomeric nipple on the bottom end of the dispenser.

SUMMARY OF THE INVENTION (1) Progressive contribution to the art

I have invented a container for carrying and dispensing golf tees that is compact and convenient. The container comprises a tube with an upper partition covering the top of the tube, and a lower partition covering the bottom of the tube. The partitions are made of elastomeric material. The golf tees are stored between the two partitions. The diameter of the tube is less than the length of a golf tee. The tube length is greater than the length of a golf tee but does not have to be much greater than the length of a golf tee.

The upper partition has a single circular aperture. The aperture diameter is slightly bigger than the diameter of the shaft of a golf tee; yet the aperture diameter is less than the diameter of the head of a golf tee. The size of the aperture allows a golf tee to be easily inserted pointed end first into the aperture. After the pointed end of a tee is inserted into the upper aperture, the tee can be forced through the partition of elastomeric material into the storage area. The size of the aperture prevents a stored golf tee from coming out of the upper aperture.

The lower partition has several apertures, usually of the same dimension. The diameter of any one of the apertures is slightly bigger than the diameter of the shaft of a golf tee; yet the diameter is less than the diameter of the head of a golf tee. The size of the aperture allows the pointed end of a golf tee to pass through an aperture, yet the tee will not immediately fall out of the container.

To remove a golf tee from the container, the golfer shakes the golf tee shaker until a tee shaft is exposed beneath the lower partition. Then the golfer grabs the shaft of the golf tee and pulls downwards until the tee is removed from the shaker.

The golf shaker has a cord and a cord clamp so that the golf tee shaker can be attached to a golf bag. Also, an advertising indicia can be put on the tube.

(2) Objects of this invention

An object of this invention is to provide a compact and convenient dispenser for golf tees.

A further object of this invention is to provide a space for advertising indicia on a golf tee dispenser.

A further object of this invention is to provide a carrier for golf tees which prohibits accidental loss of tees.

A further object is to provide a way to attach the golf tee shaker to a golf bag.

Further objects are to achieve the above with a device which is sturdy, durable, light-weight, simple, safe, efficient, versatile, ecologically compatible, energy conserving and reliable; yet is inexpensive and easy to manufacture, install, and maintain.

The specific nature of the invention, as well as other objects, uses, and advantages thereof, will clearly appear from the following description and from the accompanying drawings, the different views of which are not necessarily scale drawings.

Figure 1:
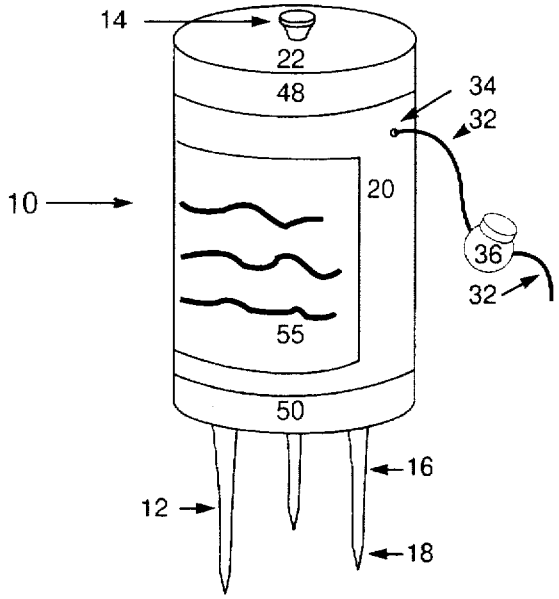
FIG. 1 is a perspective view of the preferred embodiment of the golf tee shaker with a golf tee in the upper aperture and with two tees in the lower apertures.

As an aid correlating the terms of the claims to the exemplary drawings the following catalogue of elements is provided:

10 golf tee shaker
12 golf tee
14 head
16 shaft
18 pointed end
20 tube
22 upper partition
24 lower partition
26 upper aperture
28 lower apertures
30 knot
32 cord
34 hole
36 cord clamp
38 top section
40 middle section
42 bottom section
44 upper ledge
46 lower ledge
48 upper ring
50 lower ring
52 ring end
54 ring end
55 indicia
56 golf bag
58 cord loop

DESCRIPTION OF THE PREFERRED EMBODIMENTS

Figure 4:
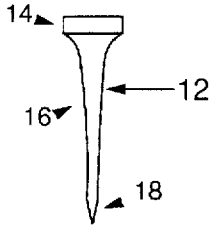
FIG. 4 is a sectional view of a golf tee.

Referring to the drawings, and FIG. 1 in particular, there is illustrated golf tee shaker 10. The golf tee shaker provides a compact and convenient means for a golfer to carry and dispense golf tees 12. A typical golf tee has head 14, shaft 16, and pointed end 18 as is shown in FIG. 4. The shaker comprises tube 20 which is covered at the top by upper partition 22. The tube is covered at the bottom by lower partition 24. The upper and lower partitions are made of an elastomeric material. The tube is preferably made of a rigid polymeric material. The tube has a diameter which is less than the length of a golf tee. The tube length should be greater than the length of a golf tee. For two and one-eighth inch long golf tees, a tube with a diameter of one and seven-eighth inches and a tube length of three inches is recommended.

Figure 2:
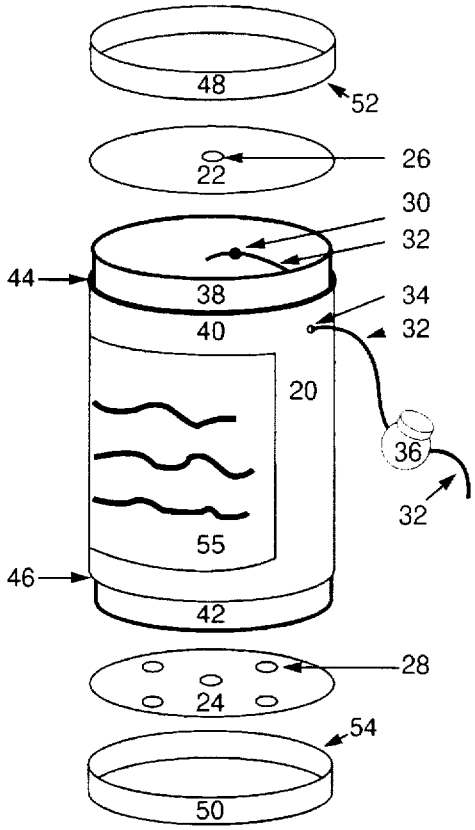
FIG. 2 is an exploded of the golf tee shaker.

FIG. 2 shows how the golf shaker is assembled. Initially, knot 30 is tied in one end of the cord 32. Then the cord is threaded through hole 34 in the tube 20. The cord is then attached to the cord clamp 36.

The upper partition 22 has upper aperture 26. The aperture diameter is slightly greater than the diameter of the golf tee shaft 16, but less than the diameter of the golf tee head 14. The lower partition 24 has lower apertures 28. The diameters of these apertures are slightly greater than the golf tee shaft diameter, but less than the golf tee head diameter. The size of the apertures prevent golf tees that are between the two partitions from unintentionally falling out of the golf tee shaker.

The tube 20 has top section 38, middle section 40, and bottom section 42. The outside diameter of the top section is less than the outside diameter of the middle section and forms upper ledge 44. The outside diameter of the bottom section is less than the outside diameter of the middle section and forms lower ledge 48.

Upper ring 48 and lower ring 50 have the same outside diameter as does the middle section 40. The inside diameter of the upper ring is slightly larger than the outside diameter of the top section 38 of the tube 20. The inside diameter of the lower ring is slightly larger than the outside diameter of the bottom section 42 of the tube.

To assemble the golf tee shaker 10, the upper partition 22 is placed on top of the top section 38 of the tube 20. Then, the upper ring 48 is connected to the tube until ring end 52 touches the upper ledge 44. The diameter of the upper partition is greater than the outside diameter of the tube so that a frictional seal is made between the upper ring, the partition, and the top section of the tube.

Next, the golf shaker 10 is turned over and the lower partition 24 is placed on top of the bottom section 42. Then, the lower ring 50 is connected to the tube until ring end 54 touches the lower ledge 46. The diameter of the lower partition is greater than the outside diameter of the tube 20 so that a frictional seal is made between the lower ring, the partition, and the bottom section of the tube.

To load the golf tee shaker 10, pointed end 18 of a golf tee 12 is inserted into the upper aperture 26 in the upper partition 22. The golf tee is then forced through the partition. This is repeated until the desired number of tees are in the shaker.

To dispense a tee, the golfer shakes the golf tee shaker 10 until a golf tee 12 falls through one of the lower apertures 28 in the lower partition 24. Then the golfer can grasp the golf tee shaft 16 and pull downwards until the golf tee 12 is removed from the shaker.

Business is often conducted on golf courses. It is desirable to have space for unobtrusive advertising. As shown in FIG. 1, indicia 55 can be placed on the middle section 40 of the tube 20.

Figure 3:
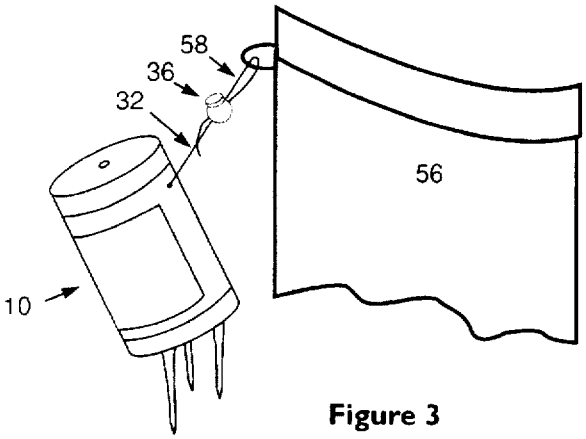
FIG. 3 is a partial plan view of a golf bag with a tee shaker attached.

As is shown in FIG. 3, the golf tee shaker 10 can be attached to golf bag 56 by the cord 32. To attach the golf tee shaker to the golf bag, one end of the cord is removed from the cord clamp 36. Then the cord is threaded through any convenient loop located on the golf bag. Then the cord is secured back in the cord clamp forming cord loop 58. The size of the cord loop can be adjusted by adjusting the position of the cord clamp. The cord can also be looped around anything that sticks up out of the golf bag, such as a golf club (not shown), and the golf tee shaker can hang over the side of the golf bag.

The embodiments shown and described above are only exemplary. I do not claim to have invented all the parts, elements, or steps described. Various modifications can be made in the construction, material, arrangement, and operation, and still be within the scope of my invention.

The restrictive description and drawings of the specific examples above do not point out what an infringement of this patent would be but are to enable one skilled in the art to make and use the invention. The limits of the invention and the bounds of the patent protection are measured by and defined by the following claims.

What is claimed is:

1. A container and dispenser for golf tees, said container comprising a cylindrical body having a hollow interior with diameter less than length of a tee, said body having an exterior upon which printing can be permanently imposed;

a resilient deformable elastomeric first closing end attached to said body for closing one end of the body;

an aperture in for inserting said tees into said body through said first closing end;

a resilient deformable elastomeric second closing end attached to said body for closing the opposite end of said body;

a multiplicity of apertures in said second closing end, for removing said objects;

a hanger secured to said body for suspending and dispensing said container in a convenient location.

2. A container and dispenser for golf tees, said container comprising a cylindrical body having a hollow interior with diameter less than length of a tee, said body having an exterior upon which printing can be permanently imposed;

a resilient deformable elastomeric inserting and closing end attached to said body for closing one end of the body;

an aperture in said resilient deformable inserting and closing end for inserting said tees into the cylinder through said inserting end;

a resilient deformable elastomeric dispensing and closing end attached to said body for closing the opposite end of the cylinder;

a multiplicity of apertures in said dispensing and closing end, for removing said tees;

a hanger secured to said body for suspending said container to a golf bag or cart.

* * * * *